US005564448A

United States Patent [19]

Lincoln

[11] Patent Number: 5,564,448

[45] Date of Patent: Oct. 15, 1996

[54] CONTAINER WASHING APPARATUS AND SYSTEM

[75] Inventor: Thomas C. Lincoln, Ft. Thomas, Ky.

[73] Assignee: Eagle-Picher Industries, Inc., Cincinnati, Ohio

[21] Appl. No.: 355,608

[22] Filed: Dec. 14, 1994

[51] Int. Cl.[6] ..... B08B 3/02

[52] U.S. Cl. ..... 134/166 R; 134/152; 134/131; 134/170; 239/550

[58] Field of Search ..... 134/166 R, 152, 134/131, 201, 170; 239/397, 550, 557, 600

[56] References Cited

U.S. PATENT DOCUMENTS

| | | | |
|---|---|---|---|
| 2,548,788 | 4/1951 | Helme . | |
| 2,574,069 | 11/1951 | Stanley | 134/152 |
| 2,617,435 | 11/1952 | Kessler | 134/152 |
| 2,665,946 | 1/1954 | Broughton . | |
| 2,910,992 | 11/1959 | Wilcox | 134/152 |
| 3,447,755 | 6/1969 | Cartwright . | |
| 3,845,635 | 11/1974 | Perkins et al. . | |
| 3,938,532 | 2/1976 | Babunovic | 134/152 X |
| 4,165,756 | 8/1979 | Sirch et al. | 134/152 X |
| 4,185,781 | 1/1980 | O'Brien . | |
| 4,397,694 | 8/1983 | Maxelon | 134/151 |
| 4,471,913 | 9/1984 | Hofmann | 239/550 |
| 4,527,745 | 7/1985 | Butterfield et al. . | |
| 4,915,305 | 4/1990 | O'Brien et al. . | |
| 5,028,007 | 7/1991 | Wokal | 239/550 |
| 5,065,944 | 11/1991 | D'Amato . | |
| 5,190,222 | 3/1993 | Haruch . | |
| 5,190,224 | 3/1993 | Hamilton . | |
| 5,199,649 | 4/1993 | Tolboll . | |
| 5,264,036 | 11/1993 | Haas et al. | 134/122 R |
| 5,326,036 | 7/1994 | Wilger . | |
| 5,333,790 | 8/1994 | Christopher . | |
| 5,333,794 | 8/1994 | Haruch . | |
| 5,356,480 | 10/1994 | Melgeorge | 134/64 R |

*Primary Examiner*—Frankie L. Stinson
*Attorney, Agent, or Firm*—Wood, Herron and Evans, P.L.L.

[57] ABSTRACT

A container washing apparatus for washing containers such as beverage cans. An elongated liquid supply pipe includes a plurality of angled fittings connected along opposite sides of the pipe. Each fitting includes quick connect and disconnect structure on its outer end for mating with like structure of a fan spray nozzle. The fan spray nozzles may be turned onto the ends of the angled fittings in a quick twisting bayonet motion to align each of the elongated fan spray patterns parallel to one another and to the longitudinal axis of the pipe. In a preferred embodiment, the container washing apparatus is used in a washing system including a liquid permeable conveyor for moving a plurality of containers, such as beverage cans, past a plurality of elongated spray pipes of the invention which are mounted adjacent upper and lower sides of the conveyor in a perpendicular orientation relative to the movement of the conveyor.

19 Claims, 4 Drawing Sheets

CONTAINER WASHING APPARATUS AND SYSTEM

BACKGROUND OF THE INVENTION

The present invention generally relates to spray washing systems and, more particularly, to container washing apparatus including one or more liquid supply pipes each having a series of aligned fan spray nozzles.

Conventional container washing systems utilize a large quantity of spray nozzles, often several hundred or thousands in number, extending from opposite sides of several supply pipes. The supply pipes are mounted both over and under a liquid permeable conveyor mat formed of an open mesh material, such as plastic or stainless steel, which moves the containers past the spray nozzles. In such container washing systems, the containers may move along a path often stretching over one hundred feet long and past many different washing, rinsing and treating stations of the system. The spray nozzles at washing and rinsing stations are usually of the type that discharge an elongated, narrow "fan" spray. Pressurized fan sprays are very effective for the washing operations. When oriented correctly and precisely, the use of fan sprays results in full, efficient spray coverage and prevents cans from being dislodged or knocked over on the conveyor.

The proper orientation of the spray nozzles is one in which all of the fan sprays discharged from a given supply pipe are aligned in a staggered fashion, but parallel with one another and parallel to the longitudinal axis of the supply pipe. Also, when used in a container washing system having opposed pipes mounted above and below the conveyor with the spray nozzles of each pipe respectively oriented downwardly and upwardly, opposed spray nozzle orifices must be directly aligned with each other. This prevents the opposing fan sprays from dislodging or knocking over the moving containers, especially lightweight aluminum or steel beverage cans. Instead, fan sprays which are directly opposed and aligned with respect to one another will act on the cans in a stabilizing manner.

In the past, spray nozzles have been attached to the supply pipes by straight or elbow fittings threaded directly into the supply pipes. Such fittings generally include two externally threaded portions, one on each the opposite ends thereof. The first end is threaded into a supply pipe, while the other end receives an internally or externally threaded nozzle. The fitting is meant to remain in place once it is connected to a supply pipe. The nozzle, however, needs to be removed and replaced quite often for cleaning and maintenance purposes.

Large amounts of time are spent by maintenance personnel to initially install the large number of fan spray nozzles during set-up of the system and during the removal and attachment all of the spray nozzles periodically for cleaning, maintenance or replacement purposes. This system "downtime" or inactivity is obviously costly and undesirable. Unfortunately, with current systems such as large can washing systems, installation and maintenance is a lengthy, labor intensive process due to the very large number of nozzles. Each nozzle must be threaded onto a supply pipe fitting in a fluid tight manner, while also orienting the fan spray pattern of each nozzle precisely parallel to the central longitudinal axis of the supply pipe and to the oppositely directed nozzle of an opposed supply pipe. This is often very difficult when straight threaded fittings are being used because, as a spray nozzle is being threaded onto the fitting, the threaded fitting many times will turn into the supply pipe. In all applications using threaded nozzles, the inaccurate nature of the threads themselves makes precise alignment very difficult.

The process of aligning all of the spray nozzles in the manner described above has generally been a trial-and-error process. Certain attempts have been made to make the attachment and alignment process easier. For example, system installers or maintenance personnel have placed markings on the spray nozzles and associated fittings to indicate when the nozzle should stop being turned relative to the fitting. Unfortunately, crude markings cannot indicate the rotational position of the nozzle relative to the fitting with the precision necessary to properly align a fan spray pattern. Also, this alignment method relies on the threaded fitting remaining stationary and, in the case of a straight fitting, fails as soon as the fitting turns into the pipe during the attachment of the spray nozzle.

U.S. Pat. No. 2,548,788 discloses a pasteurizing device which utilizes a central supply pipe having a plurality of spray nozzles attached thereto. While these spray nozzles are not threaded directly into the supply pipe, they still include spray nozzle caps threaded onto nipples which, in turn, are threaded into nozzle attachments connected to the supply pipe by laterally extending tubes. This arrangement therefore does not solve the problems mentioned above for the specific application of fan spray nozzles which must be repeatedly attached in precise alignment. Due to the threaded connections of the various nozzle parts disclosed in U.S. Pat. No. 2,548,788, too much "play" or part rotation would be possible during each nozzle attachment procedure. Although integral, one-piece threaded elbow fittings are also known, even these are undesirable due to the inherent imprecision of the threaded nozzle attachment.

It would therefore be desirable to provide a spray system and, more particularly, a container washing apparatus in which a large number of fan spray nozzles may be quickly connected to one or more supply pipes in a fluid-tight manner and with their fan spray patterns in precise parallel alignment with each other and with the longitudinal axis of the supply pipe.

SUMMARY OF THE INVENTION

The present invention provides a container washing apparatus which includes an elongated fluid supply pipe and a plurality of angled fittings connected along at least one side of the supply pipe. At one end, the angled fittings are secured to the supply pipe and at the other end they receive a fan spray nozzle. The fan spray nozzle is of the bayonet type requiring only a short twisting action in order to be connected and disconnected from the angled fitting. The angled fittings and nozzles have mating structure including respective stop surfaces which engage to stop the fitting after it has been twisted to the proper orientation. The angled fitting is rigidly formed in one piece without moving parts which could rotate or otherwise misalign as the spray nozzle is turned onto the outer end of the fitting.

The angle of discharge from the nozzle with respect to the axis of an outer portion of the fitting combined with the angle between the inner and outer portions of the fitting results in a spray discharge which is substantially perpendicular to a longitudinal axis of the inner portion of the fitting. In a first embodiment, the fittings are right angle fittings and the nozzle discharges a spray pattern parallel to the outer portion of the fitting. These right angle fittings are connected to the supply pipe such that the outer portions thereof extend perpendicular to the longitudinal axis of the pipe. The fan spray patterns discharged by the spray nozzles all extend parallel to each other and to the longitudinal axis of the supply pipe. As will be appreciated, many combinations of angled fittings and fan spray nozzles may be used while still obtaining the benefits of the invention.

Preferably, the angled fittings are integrally formed as by being molded from a plastic material. Depending on the liquid temperatures in the particular system, or on other factors, it may also be desirable to use a metal such as stainless steel to integrally form the fittings. The inner end of each fitting is preferably externally threaded so that the fittings may be attached to threaded holes in the supply pipe. It will be appreciated that the angled fittings are turned about a first axis for attachment and detachment with respect to the supply pipe, while the nozzles are turned about a second axis which is transverse or even perpendicular to the first axis. As the fitting is rigidly formed without multiple rotating components, this ensures that turning the nozzles onto the angled fittings will not result in any turning of the angled fitting which might cause misalignment of the fan spray pattern. The spray nozzles are therefore easily and precisely rotated 90 degrees onto the outer ends of the angled fittings.

The present invention more specifically contemplates a container washing system employing a plurality of supply pipes as described above, but preferably having angled fittings and nozzles extending from opposite sides of the pipe. Also, supply pipes are preferably mounted both above and below a liquid permeable conveyor which carries containers, such as cans, from one station to the next. The pipes are oriented transversely and, most preferably, perpendicularly relative to the direction of movement of the cans. Upper and lower supply pipes and the attached spray nozzles are mounted in directly opposed positions so that relative upper and lower surfaces of the container are simultaneously impinged by the opposed fan sprays.

It will be appreciated from the foregoing that the container washing apparatus of this invention provides for very fast and precise alignment of a large number of fan spray nozzles along a central supply pipe. The combination of rigid, angled fittings and bayonet type fan spray nozzles provides for this fast and accurate connection and alignment while preventing misaligning movements of the angled fitting during the attachment. Moreover, all of the component parts may be cost efficiently formed from plastic material in many applications.

These and other advantages of the invention will become more readily apparent upon further review of the following detailed description of a preferred embodiment of the invention taken in conjunction with the accompanying drawings.

DETAILED DESCRIPTION OF THE PREFERRED EMBODIMENT

Figure 1:
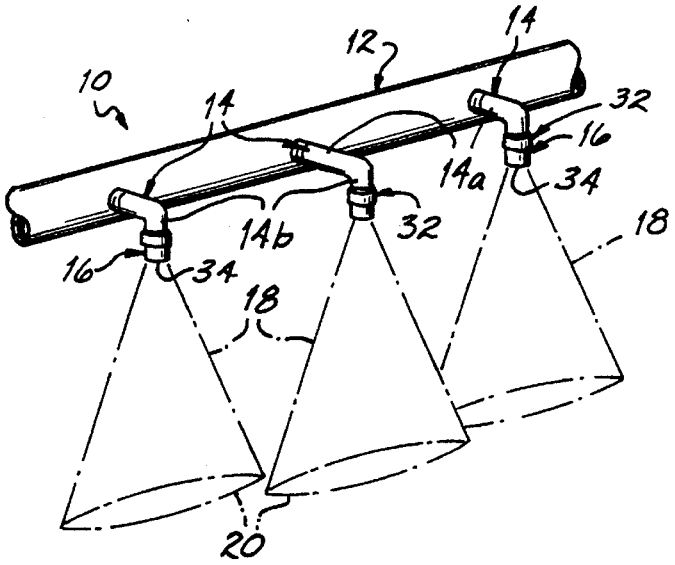
FIG. 1 is a perspective view of a container washing apparatus constructed according to one embodiment of the present invention and showing the preferred fan spray pattern.

Referring first to FIG. 1, a container washing apparatus 10 in accordance with a first embodiment of the present invention includes an elongated liquid supply pipe 12 having a plurality of angled fittings 14 extending therefrom with spray nozzles 16 affixed to the ends of the angled fittings 14. In this first preferred embodiment, angled fittings 14 are formed with a right angle between two portions **14*a*, 14*b* thereof. Thus, portion 14*a* may extend horizontally from supply pipe 12, and portion 14*b* will extend vertically to spray liquid 18 directly down on a plurality of containers (FIGS. 6 and 7) moving past apparatus 10. Of course, as will become apparent from the description of FIGS. 6 and 7 below, apparatus 10 may also be used to spray liquid, such as water, upwardly onto containers as well. The spray pattern discharged from each nozzle 16 is a "fan" spray pattern 20** having an elongated, narrow and generally elliptical cross-section.

Figure 2:
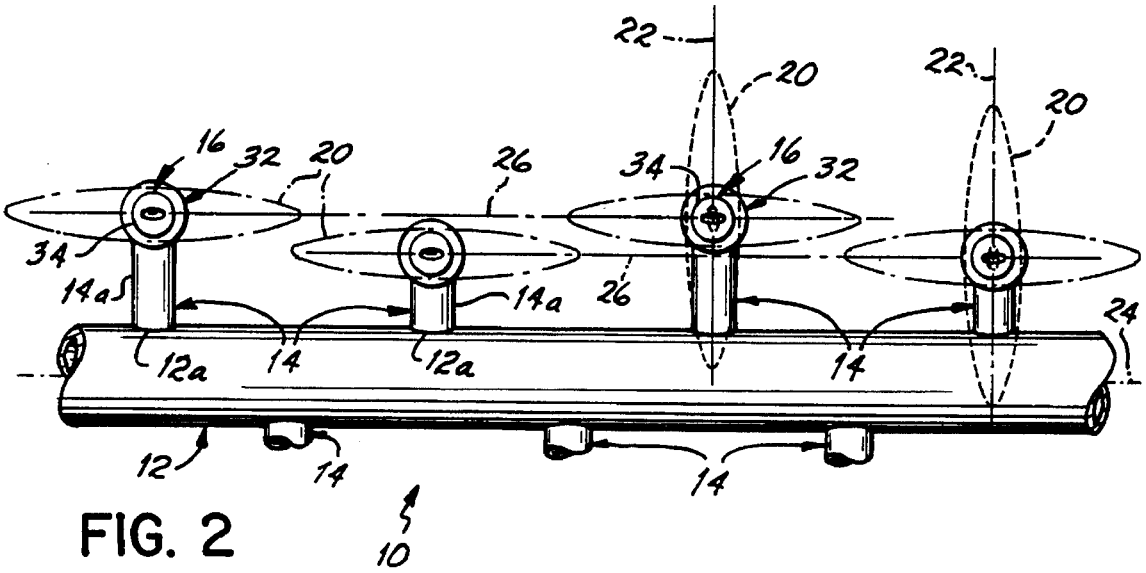
FIG. 2 is a bottom view of the container washing apparatus of FIG. 1 but schematically showing the 90 degree turning action of the spray nozzles with respect to the angled fittings.
Figure 3:
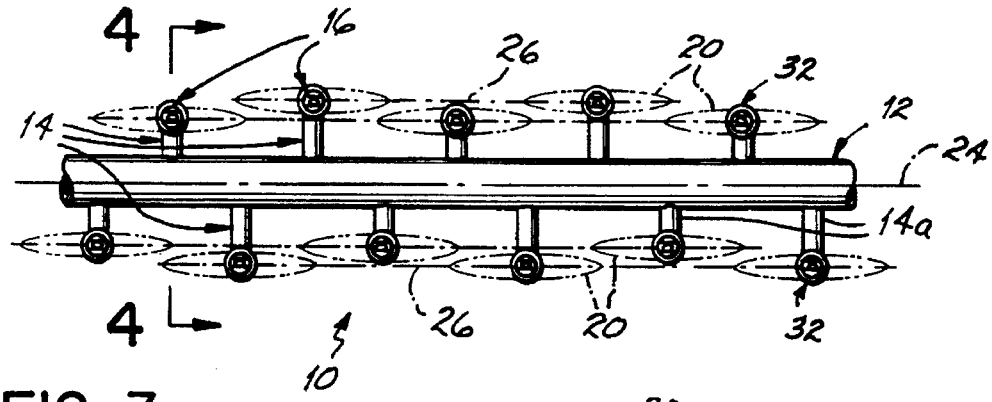
FIG. 3 is a bottom view similar to FIG. 2 but showing a series of angled fittings and spray nozzles attached to opposite sides of a supply pipe and in the preferred staggered, parallel alignment.

Referring now to FIGS. 2 and 3, angled fittings 14 are formed with horizontal portions **14*a* having respectively staggered lengths. That is, every other angled fitting 14 has a horizontal portion 14*a* of the same length. As will be appreciated from FIGS. 2 and 3, this allows the ends of adjacent fan spray patterns 20 to overlap to provide fully spray coverage along the length of apparatus 10 while preventing interference between adjacent spray patterns 20. As schematically shown in FIG. 2, fan spray nozzles 16 are of a "bayonet" or "quick connect" type requiring only a short twisting motion to be secured to angled fittings 14 in a fluid-tight manner. Thus, nozzles 16 are initially received by angled fittings 14 such that their fan spray pattern 20 would be oriented as shown in dashed lines in FIG. 2 extending along an axis 22 perpendicular to the longitudinal axis 24 of supply pipe 12. After the short twisting motion, which is preferably a 90° motion, the fan spray patterns 20 of each nozzle 14 are aligned parallel with one another along axes 26 and parallel to axis 24 of supply pipe 12. As further shown in FIG. 3, supply pipe 12 preferably includes angled fittings 14 and attached nozzles 16 connected to opposite sides thereof. For optimum results, all of the fan spray patterns 20 must be in parallel alignment as shown in FIG. 3**.

Figure 4:
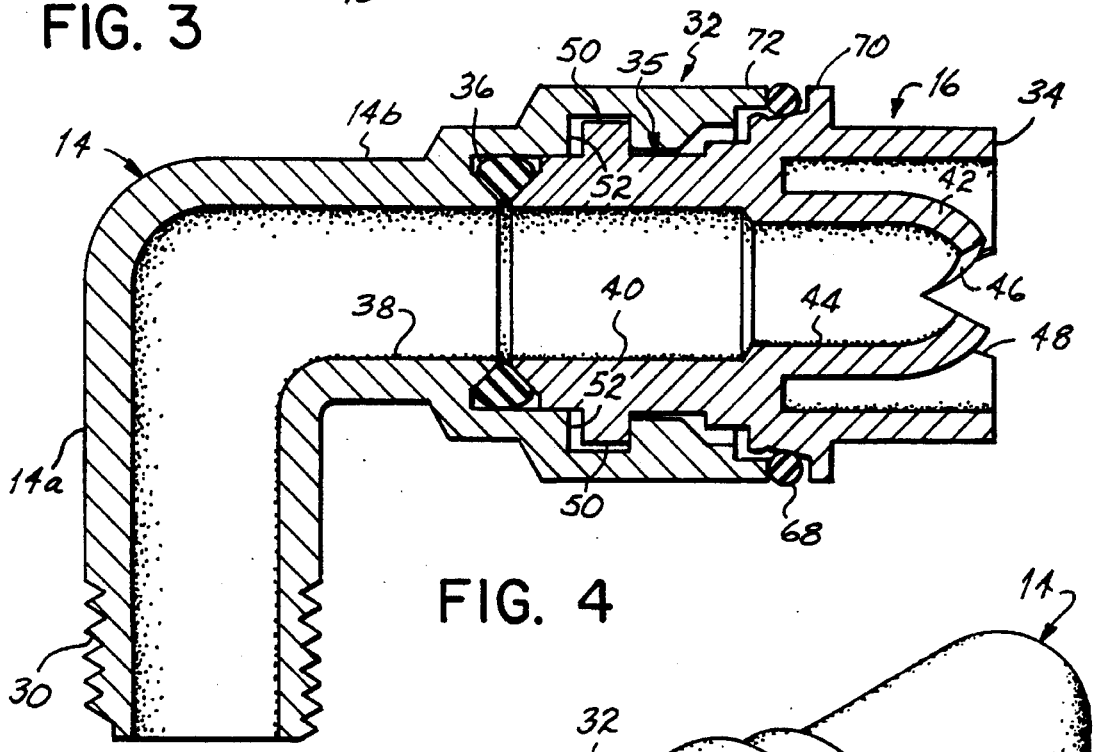
FIG. 4 is side cross sectional view of a right angle fitting and fan spray nozzle constructed in accordance with the first embodiment of this invention.
Figure 5:
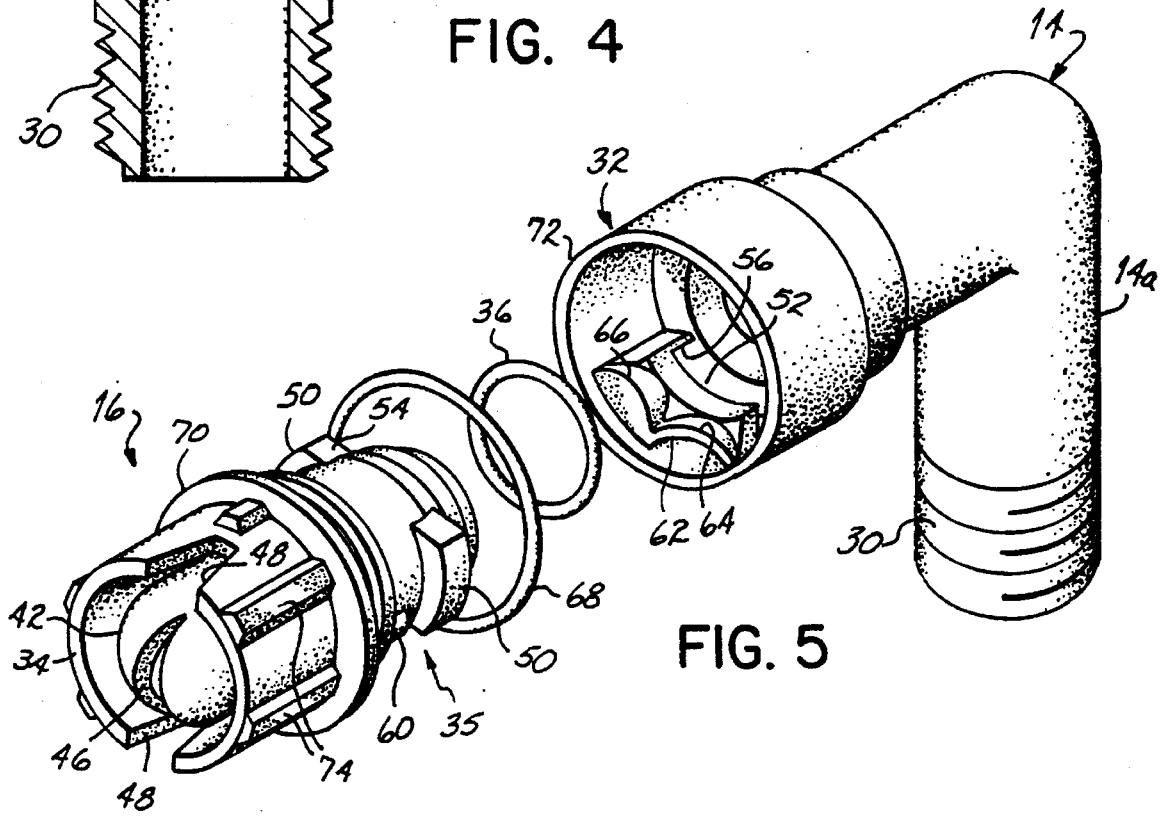
FIG. 5 is an exploded perspective view of the right angle fitting and fan spray nozzle shown in FIG. 4; and, FIG. 6 is a perspective view of a container washing system which includes apparatus constructed in accordance with the first embodiment of the present invention.

The specific angled fitting 14 and fan spray nozzle 16 used in the preferred embodiment are detailed in FIGS. 4 and 5. The "bayonet" type or "quick connect" structure used to connect nozzle 16 to angled fitting 14 is disclosed in U.S. Pat. No. 5,190,224 (the '224 patent), the disclosure of which is hereby fully and expressly incorporated by reference herein. The '224 patent is referred to for a full discussion of this connecting structure, however, for purposes of its incorporation herein, a description of FIGS. 4 and 5 will suffice. It will be appreciated that other "quick connecting" structure may be used for nozzles 16 than the structure described herein, while still retaining the benefits of quick and positive fan spray alignment.

As illustrated in FIGS. 4 and 5, angled fitting 14 is a one-piece integrally formed structure. Preferably, angled fitting 14 is injection molded from a plastic material, such as polypropylene, but may also be integrally formed from a metal such as stainless steel. Fitting 14 includes external threads 30 for allowing connection thereof to an internally threaded hole 12*a* in supply pipe 12 (FIG. 2). At the opposite end, fitting 14 includes a female "bayonet" or "quick connect" type connector portion 32. Nozzle 16 includes a spray nozzle tip 34 and a male "bayonet" or "quick connect" portion 35 which connects with a quick twisting motion to female portion 32 of angled fitting 14. An O-ring seal member 36 is compressed between connector portions 32 and 35 after connection as shown in FIG. 4.

As best shown in FIG. 4, angled fitting 14 includes an internal bore or liquid passage 38 and the upstream end of nozzle 16 is likewise formed with an internal bore or fluid passage 40 sized similarly to passage 38. Nozzle 16 further includes a forward conduit portion 42 defining a slightly reduced diameter bore 44. Bore 44 communicates with bore 40 and ends at a downstream end defining a curved end having a "V"-shaped outlet orifice 46. The narrow, "V"-shaped outlet orifice 46, shown best in FIG. 5, produces the fan spray patterns 20 (FIG. 3) which may be quickly and precisely aligned in accordance with the present invention. Spray nozzle tip 34 further includes cut-outs 48 to prevent disruption or interference of the discharged spray.

Camming lugs 50 are provided on the upstream end of nozzle 16 and cooperate in a short twisting motion with respective 15 cam slots 52 within portion 32 of angled fitting 14. The ends 54 of each lug 50 act as stop surfaces with surfaces 56 (only one of which is shown in FIG. 5) at the end of slots 52. Nozzle portion 35 further includes detents or projections 60 for cooperating with detent receiving structure 62 of connector portion 32, only one of each being shown in FIG. 5. Specifically, and as more fully detailed in the '224 patent, detents 60 are received between flexible arcuate member 64 and rigid arcuate member 66 at the end of the short twisting motion of nozzle 16 with respect to connector portion 32. As best illustrated in FIG. 4, an O-ring seal member 68 provides an outer fluid seal and is captured and compressed between shoulder 70 of nozzle tip 34 and sealing end 72 of connector portion 32. As shown in FIG. 5, nozzle tip 34 is provided with lengthwise extending ribs 74 to allow the nozzle tip 34 to be manually gripped and twisted into connector portion 32.

It will be appreciated from FIG. 5 that stop surfaces 54 and 56 as well as detent structure 60 and 62 are located such that during initial insertion of nozzle 16 into connector portion 32, elongated outlet orifice 46 is oriented with its lengthwise dimension extending parallel to horizontal portion 14*a* of angled fitting 14. Then, upon twisting nozzle 16 to the position shown in FIG. 4, elongated orifice 46 will be positively stopped by stop surfaces 54, 56 and detent structure 60, 62 at a perpendicular orientation with respect to the lengthwise dimension of fitting portion 14*a*. Of course, the lengthwise dimension of elongated orifice 46 is also always oriented perpendicular to the lengthwise dimension of fitting portion 14*b*. These relative orientations are very important because when all angled fittings 14 are attached to supply pipe 12 (FIG. 1) with portions 14*a* oriented precisely horizontally and portions 14*b* oriented precisely vertically, the connection of every nozzle 16 will result in a precisely aligned spray pattern as shown in FIG. 3. As the angled fittings 14 are all rigidly formed without potentially rotating parts, and as the rotational connection of the angled fittings 14 to pipe 12 takes place about a perpendicular axis with respect to the rotational connection of nozzle 16, the quick, precise twisting connections of nozzles 16 may be firmly and positively made in a fluid-tight manner without the possibility of any other misaligning movements or rotations simultaneously taking place.

Figure 6:
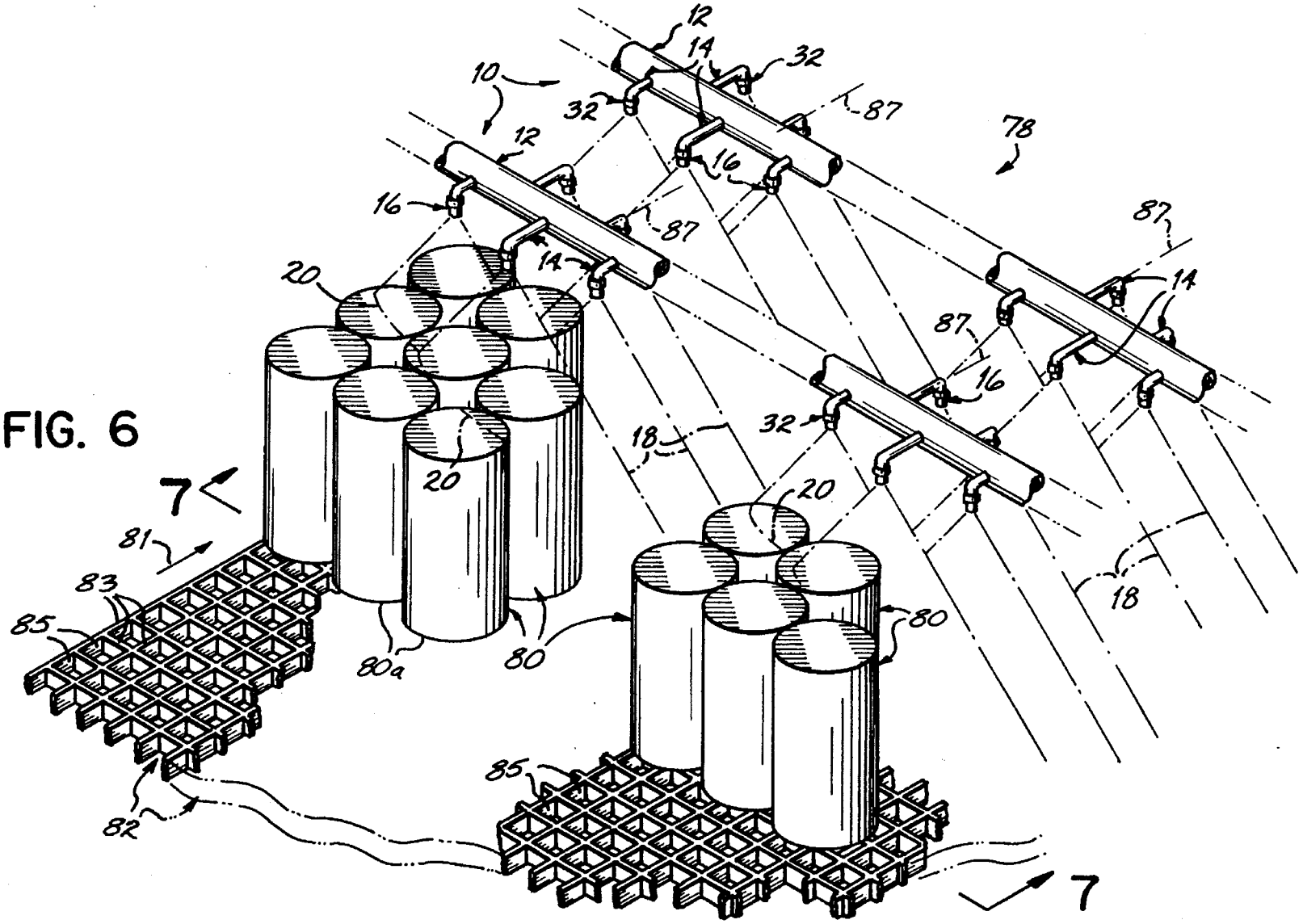
Figure 7:
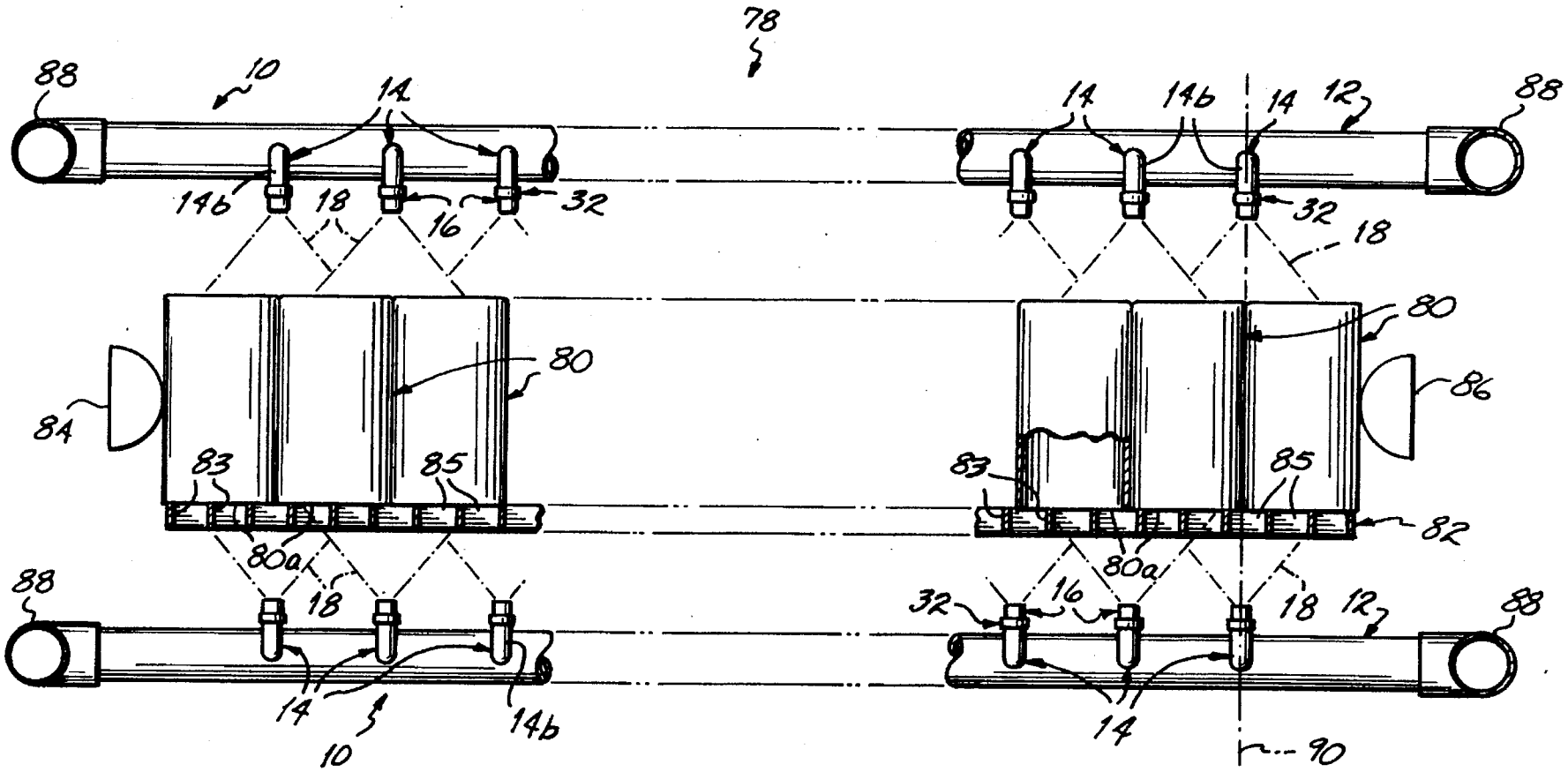
FIG. 7 is a cross sectional view of the preferred container washing system shown in FIG. 6 and taken along line 6—6 thereof.

A container washing system 78 utilizing apparatus 10 is illustrated in FIGS. 6 and 7. Specifically, system 78 is shown in a washing application involving aluminum beverage cans 80 moving along a liquid permeable, mesh conveyor 82. Mesh conveyor is preferably formed form stainless steel strips 83 having any suitable mesh or open design which allows sprayed liquid to easily pass through openings 85 thereof to cans 80. Cans 80 are empty and placed on conveyor 82 with their open ends 80*a* facing in a downward direction (FIG. 7). Supply pipes 12 are oriented perpendicularly to the lengthwise dimension and direction of movement of conveyor 82 which is indicated by arrow 81. Thus, as shown in FIG. 6, the axes 87 of respective horizontal fitting portions 14*a* extend parallel to the lengthwise dimension and direction of movement 81 of conveyor 82 while the fan sprays 18 discharged from the respective nozzles 16 all extend precisely perpendicular to the lengthwise dimension and direction of movement 81 of conveyor 82.

As shown in FIG. 7, a plurality of spray apparatus 10 are preferably mounted in the above described fashion both above and below conveyor 82. In a typical large scale beverage can washing operation using, for example, a three to eight foot wide, one hundred or two hundred foot long conveyor passing through several washing and rinsing stations, numerous supply pipes 12 and often over one thousand fittings 14 and nozzles 16 are necessary. Cans 80 are maintained on conveyor 82 by suitable side bumpers or guides 84, 86. Each of the supply pipes 12 are mounted, for example, by way of further main supply pipes 88. Each supply pipe 12 is disposed directly over or under another supply pipe 12 as shown in FIG. 7. Each nozzle 16 is also mounted directly over or under another nozzle 16. Nozzle orifices 46 (FIG. 5) of oppositely directed nozzles 16 ideally align along one axis 90 such that their respective fan sprays 18 exactly align with each other. If cans 80 were not present, the oppositely directed fan sprays 18 would therefore tend to "cancel each other out" or meet at the same, defined elliptical pattern 20 (FIG. 1). This is very important because if the oppositely directed fan sprays 18 are substantially misaligned, then the cans would tend to be disrupted, dislodged or even knocked over by the unbalanced forces of the oppositely directed sprays 18.

Figure 8:
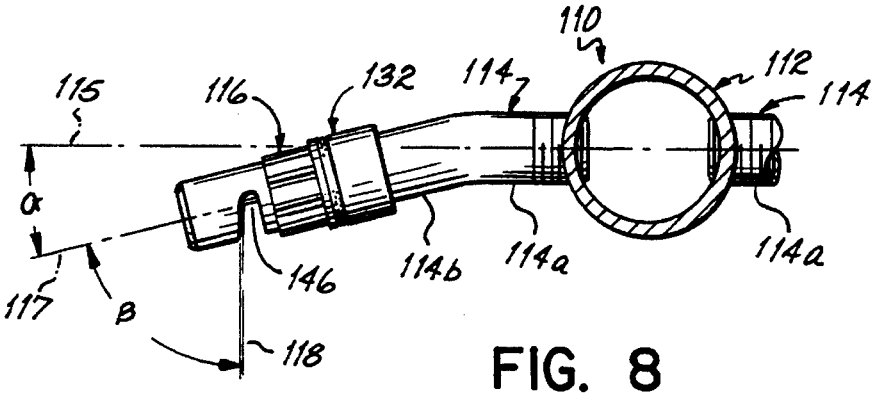
FIG. 8 is a cross sectional view illustrating an apparatus constructed in accordance with one alternative embodiment of the angled fitting and nozzle of the invention.

FIG. 8 illustrates an alternative to the right angle fittings shown in FIGS. 1–7. In FIG. 8, structure generally corresponding to that shown in FIGS. 1–7 is shown with like reference numerals in "100" series designation. Specifically, a container washing apparatus 110 is shown in cross-section taken perpendicular to the longitudinal axis of a supply pipe 112. Angled fittings 114 are threaded into pipe 112 on each side thereof just as in the first embodiment with the axis 115 of each inner fitting portion 114*a* extending perpendicular to the longitudinal axis of supply pipe 112. Outer portion 114*b* of angled fitting 114 extends along an axis 117 which is offset by an angle a from axis 115 of inner fitting portion 114*a*. The spray 118 discharged from nozzle 116 is offset by an angle $\beta$ from axis 117. The aggregate of angles $\alpha$ and $\beta$ is substantially perpendicular to axis 115 of inner fitting portion 114*a*. It is contemplated, for example, that for the nozzle design shown, angle $\alpha$ may equal 15° when angle $\beta$ is 75° for a nozzle sold under the trademark Flood Jet® by Spraying Systems Co. An additional example is an angle α of 52° and an angle β of 38° for a nozzle sold under the trademark Flood Jet® by Spraying Systems Co. Other combinations of angles are possible, of course, depending on the specific spray discharge angle of the nozzle used in the application. However, it would not be desirable to have an angle α much below 15° as the advantages of the invention may then begin to diminish.

From the foregoing description, it will therefore be appreciated that the present invention allows not only very precise alignment of fan spray nozzles in the manner necessary for systems such as beverage can washing systems, but allows large scale installation and replacement of precisely aligned fan spray nozzles in a much shorter period of time than has been heretofore possible.

While a preferred apparatus and system employing the concepts of the present invention have been described above, various modifications thereof will become readily apparent to those of ordinary skill without departing from the scope of the invention. Applicant therefore intends to be bound not by the details disclosed herein but only by the scope of the claims appended hereto.

What is claimed is:

1. Container washing apparatus comprising:

an elongated liquid supply pipe having a longitudinal axis;

a plurality of angled fittings, each angled fitting having an inner portion with a longitudinal axis and an outer portion, said inner portion being secured to said pipe for fluid communication therewith;

a plurality of fan spray nozzles, each fan spray nozzle being connected to said outer portion of a respective angled fitting, said fan spray nozzles and said outer portions of said angled fittings having mating connecting structure for allowing said fan spray nozzles to be turned between connected and disconnected positions, said structure including respective stop surfaces on the fitting and the nozzle which engage one another when an elongated fan spray pattern of said fan spray nozzle is aligned substantially parallel to said longitudinal axis of said pipe and substantially perpendicular to the longitudinal axis of said inner portion; and whereby the fan spray nozzles may be connected to the angled fittings and turned between the connected and disconnected positions without relative rotation of said angled fittings which would result in misalignment of the fan spray pattern.

2. The apparatus of claim 1 wherein said angled fittings are formed as an integral, one piece unit.

3. The apparatus of claim 2 wherein said angled fittings are right angle fittings.

4. The apparatus of claim 3 wherein said angled fittings extend from said supply pipe in staggered lengths, wherein alternating angled fittings extend the same distance from said supply pipe and, in said connected positions, all of the fan spray patterns of said fan spray nozzles are parallel with one another and parallel to said longitudinal axis.

5. The apparatus of claim 4 wherein said mating connecting structure and said stop surfaces engage and disengage with less than a full turn of said fan spray nozzle.

6. The apparatus of claim 1 wherein said angled fittings extend from said supply pipe in staggered lengths, wherein alternating angled fittings extend the same distance from said supply pipe and, in said connected positions, all of the fan spray patterns of said fan spray nozzles are parallel with one another and parallel to said longitudinal axis.

7. The apparatus of claim 1 wherein said mating connecting structure and said stop surfaces engage and disengage with less than a full turn of said fan spray nozzle.

8. A container washing system comprising:

a liquid permeable conveyor for transporting containers supported thereon;

liquid supply pipes mounted adjacent upper and lower sides of said conveyor such that a longitudinal axis of each supply pipe is disposed transverse to said conveyor;

a plurality of angled fittings connected to each supply pipe, each angled fitting having an inner portion with a longitudinal axis and an outer portion, said inner portion being secured to a pipe for fluid communication therewith;

a plurality of fan spray nozzles, each fan spray nozzle being connected to the outer portion of an angled fitting, said fan spray nozzles and said outer portions of said angled fittings having mating connecting structure for allowing said fan spray nozzles to be turned between connected and disconnected positions, said structure including stop surfaces on the fitting and the nozzle which engage one another when an elongated fan spray pattern of said fan spray nozzle is aligned substantially parallel to said longitudinal axis of said pipe and substantially perpendicular to the longitudinal axis of said inner portion; and whereby the fan spray nozzles may be connected to the angled fittings and turned between the connected and disconnected positions without relative rotation of said angled fittings which would result in misalignment of the fan spray pattern.

9. The apparatus of claim 8 wherein said angled fittings are formed as an integral, one piece unit.

10. The apparatus of claim 9 wherein said angled fittings are right angle fittings.

11. The apparatus of claim 10 wherein said angled fittings extend from said supply pipe in staggered lengths, wherein alternating angled fittings extend the same distance from said supply pipe and, in said connected positions, all of the fan spray patterns of said fan spray nozzles are parallel with one another and parallel to said longitudinal axis.

12. The apparatus of claim 11 wherein said mating connecting structure and said stop surfaces engage and disengage with less than a full turn of said fan spray nozzle.

13. The apparatus of claim 8 wherein said angled fittings extend from said supply pipe in staggered lengths, wherein alternating angled fittings extend the same distance from said supply pipe and, in said connected positions, all of the fan spray patterns of said fan spray nozzles are parallel with one another and parallel to said longitudinal axis.

14. The apparatus of claim 8 wherein said mating connecting structure and said stop surfaces engage and disengage with less than a full turn of said fan spray nozzle.

15. A fan spray fluid fitting comprising:

an angled fitting body having inner and outer portions with a common fluid passage and connected at an angle between longitudinal axes thereof, said inner portion having an inner connecting end and said outer portion having an outer connecting end, said outer connecting end having connecting structure including a stop surface; and, a fan spray nozzle including an outlet orifice for emitting an elongated fan spray pattern and connecting structure having a stop surface for engaging the connecting structure stop surface of said outer connecting end, wherein said stop surfaces of said outer connecting end and said fan spray nozzle engage during turning movement of said fan spray nozzle to define a predetermined orientation of said elongated fan spray pattern; and whereby the fan spray nozzle may be connected to the angled fitting and turned between the connected and disconnected positions without relative rotation of said angled fitting which would result in misalignment of the fan spray pattern.

16. The fluid fitting of claim 15 wherein said predetermined orientation of said elongated fan spray pattern is a substantially perpendicular orientation relative to the longitudinal axis of said inner portion of said angled fitting body.

17. The fluid fitting of claim 16 wherein the angle between the longitudinal axes of said first and second portions is a right angle.

18. The fluid fitting of claim 17 wherein said angled fitting body is an integrally formed unit.

19. The fluid fitting of claim 18 wherein said angled fitting body and said nozzle are each formed from a plastic material.

* * * * *